US005579075A

United States Patent [19]

Hagiwara et al.

[11] Patent Number: 5,579,075

[45] Date of Patent: Nov. 26, 1996

[54] AUTOMATIC PROCESSING APPARATUS FOR PROCESSING SILVER HALIDE PHOTOSENSITIVE MATERIAL AND SUPPLY METHOD OF SUPPLYING SOLID PROCESSING AGENT USED FOR SILVER HALIDE PHOTOSENSITIVE MATERIAL AND SUPPLY DEVICE THEREOF

[75] Inventors: Moeko Hagiwara; Tsuyoshi Haraguchi, both of Hino, Japan

[73] Assignee: Konica Corporation, Japan

[21] Appl. No.: 395,622

[22] Filed: Feb. 28, 1995

[30] Foreign Application Priority Data

Mar. 9, 1994 [JP] Japan ..... 6-038624

[51] Int. Cl.[6] ..... G03D 3/02

[52] U.S. Cl. ..... 396/626

[58] Field of Search ..... 354/324, 298, 354/319–322; 134/64 P, 64 R, 122 P, 122 R; 221/197

[56] References Cited

U.S. PATENT DOCUMENTS 5,400,105 3/1995 Koboshi et al. ..... 354/324

FOREIGN PATENT DOCUMENTS 109042 4/1990 Japan ..... G03C 7/413
109043 4/1990 Japan ..... G03C 7/413
39735 2/1991 Japan ..... G03C 5/38
19655 1/1992 Japan ..... G03C 7/42
230748 8/1992 Japan ..... G03C 7/407
119454 5/1993 Japan ..... G03D 3/06
188533 7/1993 Japan ..... G03C 5/00

*Primary Examiner*—D. Rutledge
*Attorney, Agent, or Firm*—Jordan B. Bierman; Bierman and Muserlian

[57] ABSTRACT

An automatic processing apparatus having a processing solution tank for processing a silver halide photosensitive material, includes a container accommodating a set of solid processing agents which can process a predetermined amount of the material, a detector for detecting an amount of the material to be processed, and a supplier for supplying an amount of the solid processing agents accommodated in the container into the processing solution tank in accordance with a detected amount of the material. The apparatus further includes a controller for controlling the supplier in which the controller controls the supplier to supply all amount of the solid processing agents remained in the container to the processing solution tank, when the processing agents are remained in the container after the predetermined amount of the material is completed to be processed. The controller controls the supplier to inhibit a supply of another set of the solid processing agents until the predetermined amount of the material is completed to be processed, when all amount of the solid processing agents in the container has been supplied onto the processing solution tank before the predetermined amount of the material is completed to be processed.

5 Claims, 15 Drawing Sheets

AUTOMATIC PROCESSING APPARATUS FOR PROCESSING SILVER HALIDE PHOTOSENSITIVE MATERIAL AND SUPPLY METHOD OF SUPPLYING SOLID PROCESSING AGENT USED FOR SILVER HALIDE PHOTOSENSITIVE MATERIAL AND SUPPLY DEVICE THEREOF

BACKGROUND OF THE INVENTION

The present invention relates to an automatic processing apparatus used for developing silver halide photosensitive material, and more particularly relates to a compact automatic processing apparatus provided with a replenishing device in which the workability is greatly improved by removing the dissolution work for dissolving a solid processing agent and the accuracy of replenishment is remarkably enhanced.

After silver halide color photosensitive material (referred to as photosensitive material in this specification hereinafter) has been exposed to light, it is subjected to the processing of development, desilvering, washing and stabilization. Monochromatic silver halide photosensitive material is developed and fixed after exposure.

Usually, the photosensitive material is developed by an automatic processing apparatus (referred to as AP or AF in this specification hereinafter), and then automatically sent to each process described above.

When photosensitive material is processed by the automatic processing apparatus, in general, the processing agent is successively replenished into a processing tank in order to maintain the activity of a processing solution in the processing tank.

Specifically, development of the photosensitive material is carried out while the replenishment solution is appropriately supplied into the processing tank from a replenishment tank.

In this case, the replenishment solution stored in the replenishment tank is generally prepared in a different place. In mini-laboratories, which have increased in number recently, when the replenishment solution in the replenishment tank near the automatic processing apparatus has been used up, a predetermined amount of the replenishment solution is prepared. When the replenishment solution is prepared, the solid processing agent is manually dissolved, or automatically dissolved with a mixer.

Commonly, a processing agent for processing silver halide photosensitive material (referred to as a photographic processing agent in this specification hereinafter) is put on the market in the form of condensed liquid. When it is put into practical use, a predetermined amount of water is added to the condensed liquid, and then the mixture is manually stirred and appropriately diluted. In this way, the replenishment solution is prepared.

When the replenishment solution is prepared in the manner described above, it takes time to dissolve the solid processing agent. While the preparation work is being carried out, the solid processing agent is not completely dissolved in the solution. Therefore, in order to prevent a replenishment solution, having a concentration which is different from a predetermined value, from being fed to the processing tank in the mini-laboratory, it is necessary to stop feeding the replenishment solution.

In general, continuous processing of photosensitive material is temporarily stopped, and after the replenishment solution has been prepared, operation is started again. For this reason, the efficiency of continuous processing of photosensitive material is lowered.

From the viewpoint of protecting the natural environment, solidification of the photographic processing agent has been developed recently. For example, solidified photographic processing agents are disclosed in Japanese Patent Publication Open to Public Inspection Nos. 109042/1990, 109043/1990, 39739/1991, 39735/1991, 19655/1992 and 230748/1992.

However, in the case where the replenishment solution is prepared from the above solid processing agent, the dissolution time of the solid processing agent is longer than the dissolution time of the liquid processing agent. Accordingly, the continuous processing operation is stopped over a long period of time, which remarkably reduces the work efficiency. Therefore, it is desired to solve the above problems.

In order to solve the above problems, Japanese Patent Publication Open to Public Inspection Nos. 119454/1993 and 188533/1993 disclose methods by which the solid processing agent is directly dispensed into the processing tank. However, even when the above technique is applied, it is difficult to stably and accurately replenish a predetermined amount of the solid processing agent.

When a predetermined amount of granular, powdery or pellet-shaped solid processing agent is measured and replenished, errors are caused, so that it is difficult to stably and accurately replenish the solid processing agent.

The following are the causes of errors of replenishment amounts.

(a) Liquid is accurately measured with a pump and others. On the other hand, small gaps tend to be formed in powder and granules. Accordingly, it is difficult to accurately measure powder and granules. In order to measure powder and granules with high accuracy, the measuring means becomes expensive.

(b) When moisture is absorbed by the solid processing agent, the volume and weight of the solid processing agent are changed after it has been set in the accommodating container. Accordingly, an error is caused in the supply amount each time.

(c) In the case of conveyance and attachment of the accommodating container, the solid processing agent is rubbed in the accommodating container, so that the granules of the solid processing agent are crushed into minute grains, and sometimes the phenomenon of blocking is caused, so that the specific volume is changed and errors are caused in the replenishment amount.

(d) When the granular solid processing agent in the accommodating container is vibrated in the process of conveyance or charging, granules of high specific gravity and small granules are locally positioned and deposited at the bottom of the container. Therefore, when a predetermined volume of the solid processing agent or a predetermined weight of the solid processing agent is measured and replenished, errors are caused in the replenishment amount each time, thereby causing errors in the total replenishment amount. When a plurality of types of granules or powders are mixed, this phenomenon appears remarkably.

(e) In the case where a plurality of granules are mixed, after the mixture has been set in the accommodating container, the composition deviates gradually, so that an error is caused in the replenishment amount. For example, in the case of a solid processing agent used for replenishment of a color developing solution, after the replenishment operation has been conducted several times, grains of a large size are left in the accommodating container. In other words, a relatively large amount of developing agent is left in the accommodating container. When this developing agent is replenished into the dissolving tank and then a highly dense solid processing agent (alkali agent) of a small grain size is charged into the dissolving tank, the solution is made muddy, and fine particles of precipitation are generated. Due to the precipitation, a filter in the dissolution tank is clogged up.

(f) Errors caused by misoperation and malfunction are not canceled. To make the matter worse, the errors are accumulated. Due to the accumulated error, the replenishment amount can not be accurately controlled, which affects the processing performance of photosensitive material.

SUMMARY OF THE INVENTION

It is an object of the present invention to provide an improved solid processing agent replenishing device capable of providing the following effects.

(1) The problems of accumulated replenishment errors are solved, and a processing solution of a stable composition is provided.

(2) Even when the deviations of the shape, volume, weight and composition of a solid processing agent are caused by the environmental humidity and vibration given in the process of conveyance, the accumulated replenishment amount error is not generated.

(3) It is not necessary to provide a complicated and precise replenishment device, and the solid processing agent can be replenished using an inexpensive replenishment device.

(4) A sensor means for detecting a residual amount of the solid processing agent in the accommodating container is not required, and a complicated control means is not required either.

(5) Precipitation is not generated in the processing tank, and the filter is not clogged up. Therefore, the replenishment solution is stably circulated in the filter section. Accordingly, processing is uniformly carried out.

The present inventors have found that the above problems are solved by the following composition.

The automatic processing apparatus for processing silver halide photosensitive material having a solid processing agent replenishment device of the present invention comprises:

(1) one of the solid processing agent accommodating container and the holding means for holding the solid processing agent accommodating container;

(2) a throughput information detection means for detecting the throughput of silver halide photosensitive material;

(3) a solid processing agent supply means for supplying the solid processing agent accommodated in the accommodating container into a processing solution tank of the automatic processing apparatus in accordance with the throughput information; and (4) a control means for operating the solid processing agent supply means so that the supply of all solid processing agent in the accommodating container can be completed when the area information of photosensitive material corresponding to the solid processing agent accommodated in the accommodating container and the processing area information obtained by the throughput information detecting means are compared with each other and a specific condition is satisfied.

In the method by which the solid processing agent is replenished into the automatic processing apparatus processing tank for processing silver halide photosensitive material, the control operation is conducted in the following manner: The supply of all solid processing agent in the accommodating container is forcibly completed when the predetermined area information of photosensitive material corresponding to the solid processing agent accommodated in the accommodating container and the processing area information of photosensitive material are compared with each other and a specific condition is satisfied.

In the solid processing agent supply device for supplying solid processing agents, one set of granular, powdery or pellet-shaped solid processing agents, which is accommodated in the accommodating container of the supply device of the silver halide photosensitive material automatic processing apparatus, is divided into a plurality of portions and dispensed into the processing tank.

The solid processing agent supply device comprises: a throughput information detecting means for detecting the throughput of silver halide photosensitive material; an accommodating container for accommodating one set of solid processing agent of a predetermined amount; a solid processing agent supply means for supplying the solid processing agent accommodated in the accommodating container into a processing solution tank while the solid processing agent in the accommodating container is divided into a plurality of portions; a condition setting input means for supplying the solid processing agents in the accommodating container divided into a plurality of portions; and a solid processing agent supply control means for controlling the solid processing agent supply means so that the charge of one set of solid processing agent can be forcibly completed by the solid processing agent supply means at the theoretical completion time of charge of one set of solid processing agent.

Concerning the solid processing agent used in the present invention, a predetermined amount of the solid processing agent is packed in a container so that it is formed into one unit.

In this case, the predetermined amount of the solid processing agent is defined as follows: The solid processing agent has already been measured before it is accommodated in the replenishment device of the automatic processing apparatus of the present invention, or the solid processing agent has already been measured before the accommodating container in which the solid processing agent is accommodated is set in a holding means for holding the container therein. For example, the predetermined amount is defined as a condition in which a predetermined amount of granules or powder is packed.

In the system of the present invention, one set of solid processing agent has already been measured, manufactured and packed in the processing agent manufacturing factory. This one set of solid processing agent is measured and divided into a plurality of portions, and each divided portion is charged in the processing tank. In this case, even when some errors and deviation are caused in each dispensing operation, and even when an inexpensive feed device of low accuracy is used, the errors and deviation are forcibly canceled after one set of solid processing agent has been dispensed into the processing tank. Accordingly, the errors are not accumulated. According to the above operation in which the errors and deviation are forcibly canceled, when the dispensing operation is completed before the completion of the theoretical set of the solid processing agent, the alarm is not raised, and the device waits for the next operation until the theoretical set is completed. On the contrary, when the solid processing agent remains even after the completion of the theoretical set, the residual solid processing agent is forcibly dispensed into the processing tank.

As described above, one set of the solid processing agent is forcibly dispensed, so that the accommodating container can be maintained in an empty condition every day. Accordingly, there is no possibility that a small amount of another component is mixed into a specific component, the concentration of which is high. Therefore, the composition can be maintained in a well-balanced condition. Consequently, there is no possibility that the precipitation is generated in the solution.

When the predetermined amount of one set of the solid processing agent is 100 $cm^3$ to 2000 $cm^3$, the effect of the present invention can be most effectively displayed. It is more preferable that the predetermined amount of one set of the solid processing agent is 200 $cm^3$ to 1500 $cm^3$.

When a predetermined amount of one set of the solid processing agent is small, the frequency of setting operation of the solid processing agent to the automatic processing apparatus is increased, so that the accuracy is enhanced. However, effectivity of the mechanism of completion of forcible dispensing is reduced, and further workability is extremely lowered. On the contrary, the predetermined amount of one set of the solid processing agent exceeds a predetermined value, an amount of cancelation is increased at the completion of forcible dispensing, and defective dissolution occurs, which affects the processing property.

In the conventional replenishment system for replenishing the solution, a bellows pump is usually used. However, the accuracy of the bellows pump is not constant, so that the bellows pump is not suitable for accurate replenishment control.

In the case of the solid processing agent of the present invention, for example, the solid processing agent is preferably measured and manufactured in a manufacturing factory, and replenishment control is conducted in such a manner that the solid processing agent is divided into a plurality of portions and each portion is dispensed into the processing tank. Accordingly, fluctuation is caused at each replenishment operation. However, in the present invention, all the residual solid processing agent in the accommodating container is dispensed into the processing tank at the final dispensing operation or after the final dispensing operation. Accordingly, although the accuracy of charging the solid processing agent is low each time, when the solid processing agent in the accommodating container has been consumed, all the predetermined amount of the solid processing agent is replenished, so that a stable processing performance can be provided. In the present invention, any of powdery, granular, tablet-shaped and pellet-shaped solid processing agents can be used, and, even when they are mixed with each other, no problems are caused. Even though a liquid type processing agent may be applied, however, it is preferable to use granular or tablet type solid processing agent. In the case of granular or powdery processing agent, it is preferable that the processing agent is packed with an alkali soluble film, plastic film or a sheet of paper so that one set of the solid processing agent is provided. The solid processing agent may be dispensed into a cartridge made of paper or plastic, and one set of the solid processing agent may be set in the automatic processing apparatus together with the container.

FIG. 1(A) is an arrangement view of the automatic processing apparatus AP for developing sheet-shaped photographic paper. In the automatic processing apparatus AP, the sheet-shaped photographic paper S is processed by the processing solutions in the color developing tank 1A, bleaching and fixing tank 1B, stabilization tanks 1C, 1D, 1E. After the processing has been completed, the the sheet-shaped photographic paper S is dried. As illustrated in FIG. 1(A), the levels of the stabilization tanks 1C, 1D and 1E are successively higher than the level of the bleaching and fixing tank 1B. Consequently, the solution that has overflowed the tank 1E flows into the tanks 1D, 1C, 1B by the action of gravity, so that the device is formed into the counter-current system.

FIG. 1(B) is an arrangement view of the automatic processing apparatus AF for developing negative photographic films. In the automatic processing apparatus AF, the negative photographic film f is processed by the solutions in the color developing tank 7A, bleaching tank 7B, fixing tanks 7C, 7D, and stabilization tanks 7E, 7F, 7G. After that, the negative photographic film f is dried. The solid processing agent supply devices 8A, 8B, 8D, 8G are respectively attached to the color developing tank 7A, bleaching tank 7B, fixing tank 7D and stabilization tank 7G. In this connection, the replenishment water tank 4 is constructed in the same manner as that shown in FIG. 1(A), so that the same reference numeral is attached to it.

In this specification, powder is defined as an aggregation of fine crystals. In this specification, granules are made when powder is subjected to granulation treatment, and the grain size is in a range from 50 to 5000 μm. In this specification, a tablet is defined as a piece made of powder or granules by means of compression forming, wherein the shape of the piece is predetermined.

It is preferable that the granulation is conducted for each component such as an alkali agent, reducing agent, bleaching agent and preservatives.

The granular type solid processing agent can be manufactured by common methods disclosed in Japanese Patent Publication Open to Public Inspection Nos. 109042/1990, 109043/1990, 39735/1991 and 39739/1991. Further, the powder type processing agent can be manufactured by common methods disclosed in Japanese Patent Publication Open to Public Inspection Nos. 133332/1979, British Patent Publication Nos. 725,892 and 729,862 and German Patent Publication No. 3,733,861.

From the viewpoints of improving the solubility and enhancing the effect of the present invention, it is preferable that the bulk density of the solid processing agent is 1.0 to 2.5 $g/cm^3$. In order to enhance the mechanical strength of the solid processing agent, it is preferable that the bulk density is higher than 1.0 $g/cm^3$, and in order to enhance the solubility of the solid processing agent, it is preferable that the bulk density is lower than 2.5 $g/cm^3$. In the case where the solid processing agent is composed of granules or powder, it is preferable that the bulk density is 0.40 to 0.95 $g/cm^3$.

The solid processing agent of the present invention was made by the substantially same method as that disclosed in Japanese Patent Publication Open to Public Inspection No. 109042/1990, and the granular type solid processing agents for color photographic paper use were made, that is, the solid processing agents used for the color developing replenisher agent, bleach-fix replenisher agent and stabilizing replenisher agent were made. One package unit of the solid processing agent and an amount of dispensing of the solid processing agent per one dispensing operation are shown below.

TABLE 1

| | One package unit | | Charging amount ($cm^3$) per one charging | Theoretical charging frequency | Throughput ($m^2$) of color paper per one charging |
|---|---|---|---|---|---|
| | Weight | Volume | operation | (times) | operation |
| Color developing replenisher agent | 500 g | 600 $cm^3$ | 10 | 60 | 1 |
| Bleach-fix replenisher agent | 500 g | 650 $cm^3$ | 26 | 25 | 1 |
| Stabilization replenisher agent | 250 g | 300 $cm^3$ | 2 | 150 | 1 |

When 8 $m^2$ of photographic paper of Konica Color QA Paper (manufactured by Konica Co.) is processed in one day by the automatic processing apparatus AP for processing color paper, theoretically, the solid color developing replenisher agent in the accommodating container is used up in 60 times (in 8 days), and the solid bleach-fix replenisher agent in the accommodating container is used up in 25 times (in 4 days), and the solid stabilizing replenisher agent in the accommodating container is used up in 150 times (in 19 days). However, errors are caused when the solid processing agent is measured, and further errors are caused by absorbed moisture and blocking of the solid processing agent. Therefore, when all the solid processing agent in the accommodating container is used up before the detection, the dispensing operation of the solid processing agent is not carried out and the device waits for the next operation, or alternatively after the idling operation is carried out, a signal is generated which expresses the completion of replenishment and the replacement of the accommodating container. When the solid processing agent remains in the accommodating container even after the number of dispensing operation has reached the theoretical value, all the residual solid processing agent in the accommodating container is dispensed at the final dispensing operation or after the final dispensing operation.

According to the conventional method in which an empty signal is preferentially generated when the consumption of the solid processing agent in the accommodating container is detected by the residue detection sensor, even after the empty signal has been generated by the residue detection sensor, the solid processing agent remains at a bottom of the accommodating container and a solid processing agent dispensing supply portion. For this reason, the residual solid processing agent is accumulated each time the container is replaced, so that errors are caused, and the development performance is affected after 2 months.

There is provided another conventional method in which priority is given to the theoretical dispensing frequency, and an accommodating container having a new replenisher agent is attached to the replenishing device at the 61st operation of the color developing replenisher agent, and at the 26th operation of the bleach-fix replenisher agent, and at 151st operation of the stabilizing replenisher agent. Then it has been found that a small amount of precipitation is generated in the color developing dissolution tank. Due to the color developing agent, the solid replenisher agent in the replenishment device is gradually accumulated and increased, which causes a problem.

Even when tablets are used, in some cases, they can not be smoothly supplied as was expected, because the tablets do not drop smoothly due to damage such as cracks and crack, and further, powder is generated from the tablets so that the sensor does not work correctly.

According to the present invention, the above problems can be solved in the following manner: The theoretically dispensed amount and the actually dispensed amount are checked and compared with each other by the unit of a tablet package that is a unit to be set by one operation, or by the unit of a kit. When an insufficient amount of tablets are dispensed, the residual tablets are dispensed so that the amount can be the theoretical value. When an excessive amount of tablets are dispensed, the dispensing operation is stopped until the dispensed amount becomes the same as the theoretical value. In this way, it is possible to supply the tablets accurately.

In the case of the tablet type processing agent, the number of tablets can be accurately controlled when they are dispensed. Therefore, according to the present invention, it is possible to avoid the occurrence of accumulated errors, and a predetermined amount of processing agent can be supplied.

In the above description, the tablet packaging container unit is defined as a container in which the tablets are enclosed, for example, the tablet packaging container unit is defined as a cartridge or cylinder made of plastics or paper.

In the above description, the kit unit is defined as a unit in which a plurality of the above containers are enclosed.

What is called "a set kit" accommodates a predetermined amount of each agent necessary for processing a predetermined area of photosensitive material, such as a color developing agent, bleaching agent, fixing agent and stabilizing agent. The above agents are packaged in the set kit. When the aforementioned set kit is used, all agents can be checked by one operation, so that the effect of the present invention can be more effectively exhibited.

According to the solid processing agent replenishment method of the present invention, each time an accommodating container, in which a predetermined amount of solid processing agent is accommodated is attached to the replenishment device, all the solid processing agent is dispensed for cancellation. Accordingly, the above problems such as the error caused by accumulation and the generation of precipitation can be solved. Therefore, processing can be stably carried out. Especially when a large amount of photosensitive material is processed and the accommodating container is frequently replaced, the replenishment method of the present invention can provide a remarkable effect.

It should be noted that the present invention includes a case in which only a portion of the processing agent is solidified. It is preferable that all components of the processing agent are solidified. It is also preferable that each component is individually formed into a solid processing agent so as to be provided. It should be noted that the present invention includes a case in which each component is respectively packed in the order of dispensing.

In the present invention, it is preferable that all processing agent is solidified and dispensed into each processing tank in accordance with the throughput information. In the case where replenishment water is required, it is replenished in accordance with the vaporization amount information, throughput information or another replenishment water control information. In this case, only replenishment water is replenished to each processing solution tank. In the present invention, the replenishment water is defined as a processing solution successive to the processing solution tank having the fixing performance or defined as an overflowing waste solution. In order to make the automatic processing apparatus compact, it is preferable that one water tank is provided in the automatic processing apparatus.

DETAILED DESCRIPTION OF THE PREFERRED EMBODIMENT

With reference to the accompanying drawings, an example of the present invention will be explained as follows.

Figure 1:
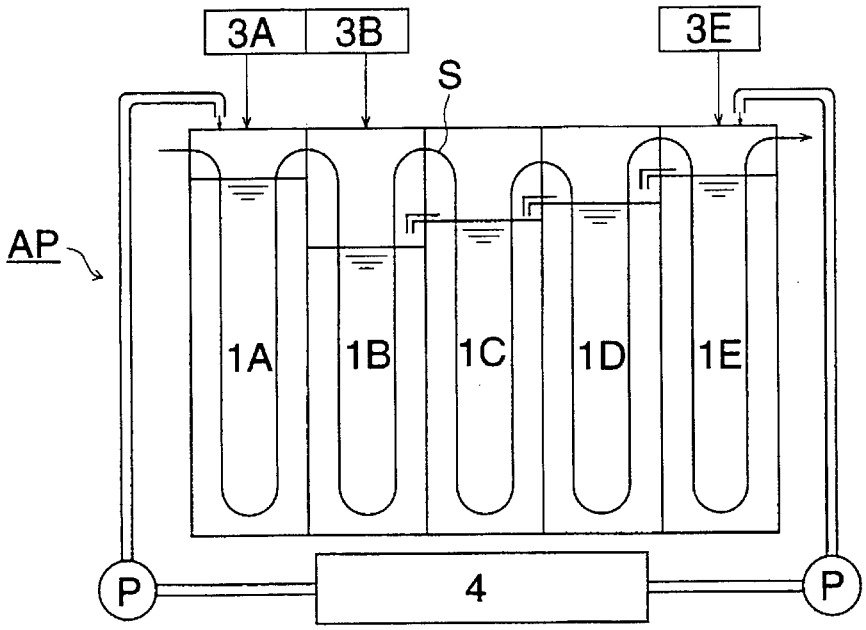
FIGS. 1(A) and 1(B) are overall arrangement views of the automatic processing apparatus.
Figure 1:
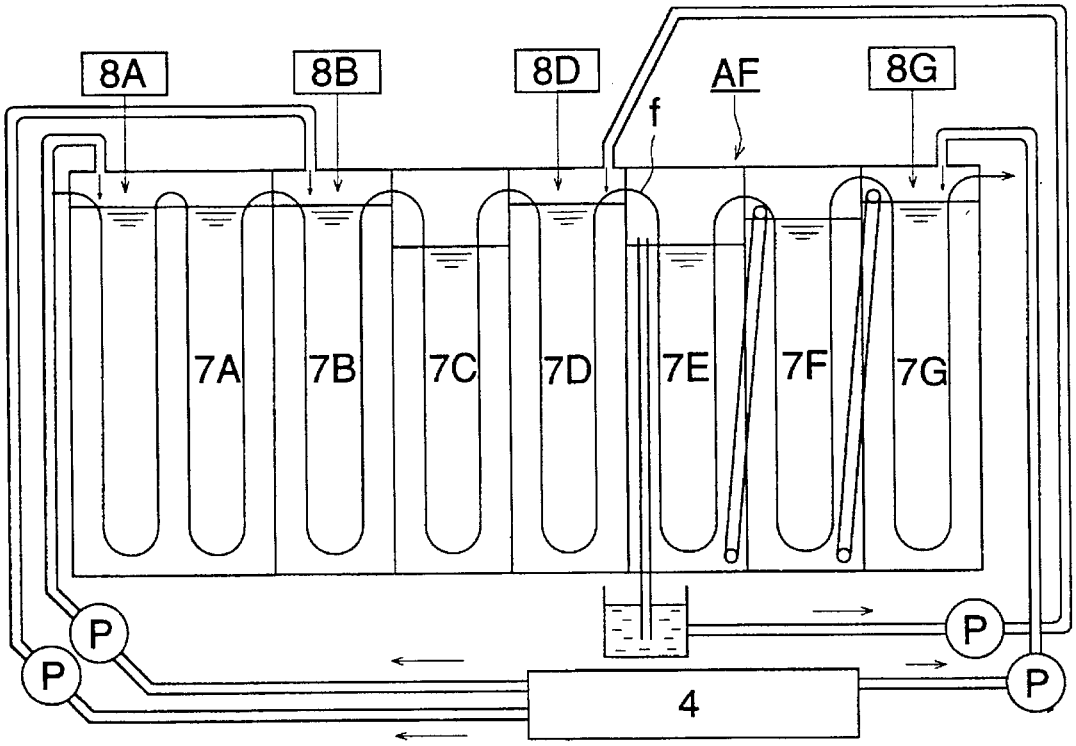
Figure 2:
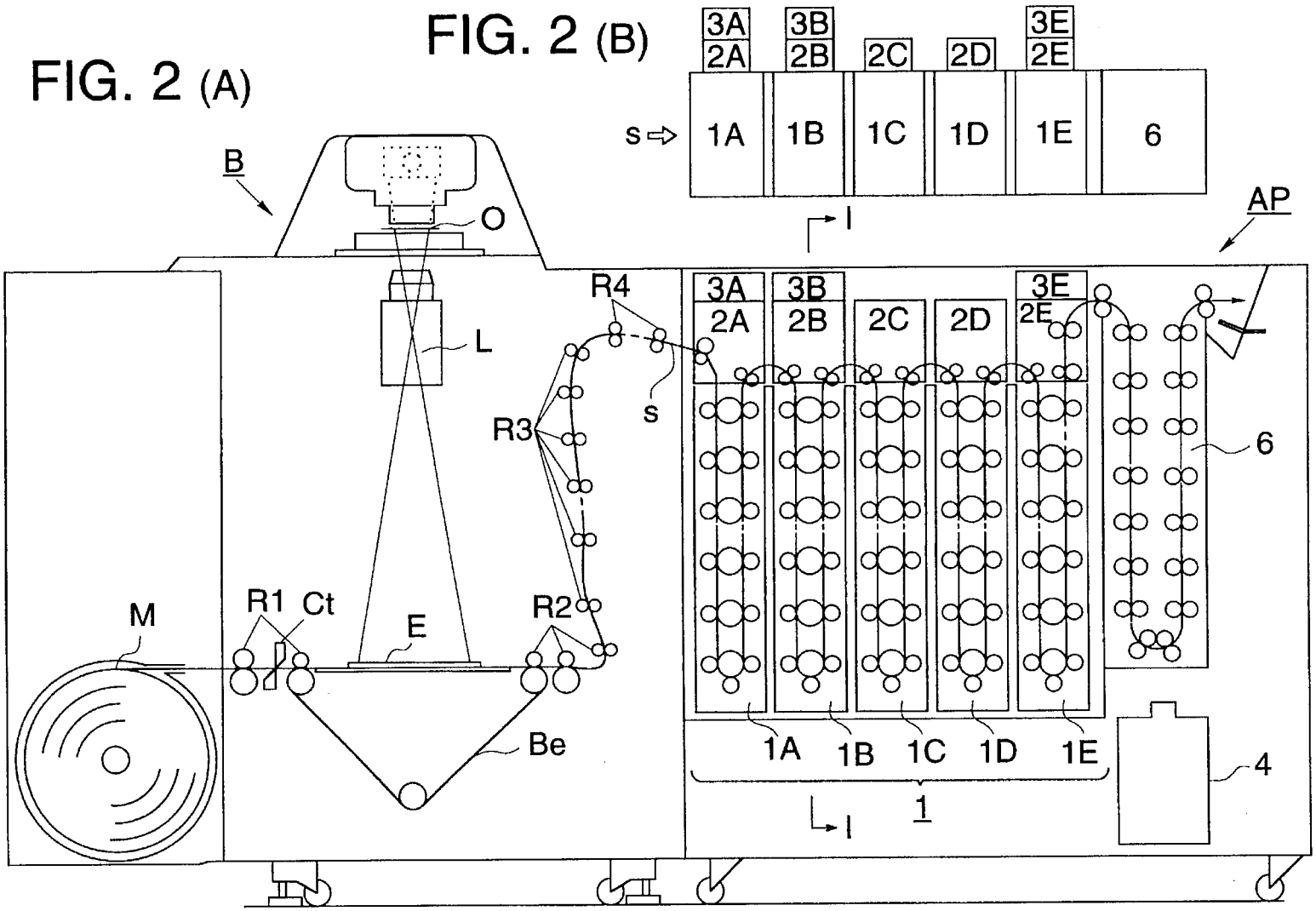
FIGS. 2 (A) and 2 (B) are overall arrangement views of the silver halide photosensitive material processing apparatus.

An automatic processing apparatus (referred to as AP or AF in this specification hereinafter) to which the present invention is applied will be explained with reference to the accompanying drawings. FIG. 2(A) is an overall arrangement view showing the construction of a silver halide photosensitive material processing apparatus (printer processor) in which the automatic processing apparatus AP and photographic printer B are integrated into one body.

In FIG. 2(A), in the left lower portion of the photographic printer B, there is provided a magazine M in which a roll of photographic paper (color paper), which is an unexposed silver halide photographic material, is accommodated. The photographic paper S is pulled out from the magazine M and conveyed by the feed rollers R1 and cut into a predetermined size by the cutter Ct. In this way, a sheet of photographic paper S can be provided. This sheet of photographic paper S is conveyed by the belt conveyance means Be. Then an image of the original 0 is exposed onto the sheet of photographic paper S by a light source and lens L in the exposure section E. The exposed sheet of photographic paper S is further conveyed by a plurality of pairs of feed rollers R2, R3 and R4, so that the sheet of photographic paper S is introduced into the automatic processing apparatus AP. In the automatic processing apparatus AP, the sheet of photographic paper S is successively conveyed by a roller conveyance means (the reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper S is subjected to color development, bleach-fix processing and stabilizing processing. After the processing has been completed, the sheet of photographic paper S is dried by the drying section 6, and then discharged outside of the apparatus.

In this connection, the one-dotted chain line in the drawing shows a conveyance passage of the photographic paper S. In this example, the photographic paper S is cut into a sheet and introduced into the automatic processing apparatus AP, however, a strip-shaped photographic paper may be introduced into the automatic processing apparatus AP.

The automatic processing apparatus AP of the present invention may be constructed integrally with the photographic printer B, or alternatively the automatic processing apparatus AP of the present invention may be constructed separately from the photographic printer B. The explanation of the present invention is made under the condition that the automatic processing apparatus AP includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic processing apparatus for processing exposed negative films f, having four tanks of a color developing tank, bleaching tank, fixing tank and stabilizing tank. Further, the present invention can be applied to an automatic processing apparatus AF (shown in FIGS. 3 and 4) having more processing solution tanks than described above.

FIG. 2(B) is an arrangement plan view of the automatic processing apparatus AP. In the color developing tank 1A, the bleaching and fixing tank 1B and the stabilizing tank 1E, there are provided dissolution tanks 2A, 2B, 2E, circulation tanks 2C, 2D and solid processing agent supply devices 3A, 3B, 3E for supplying the solid processing agent. Reference numeral 4 is a replenishment water tank for supplying replenishment water to the color developing tank 1A and the stabilizing tank 1E.

Figure 3:
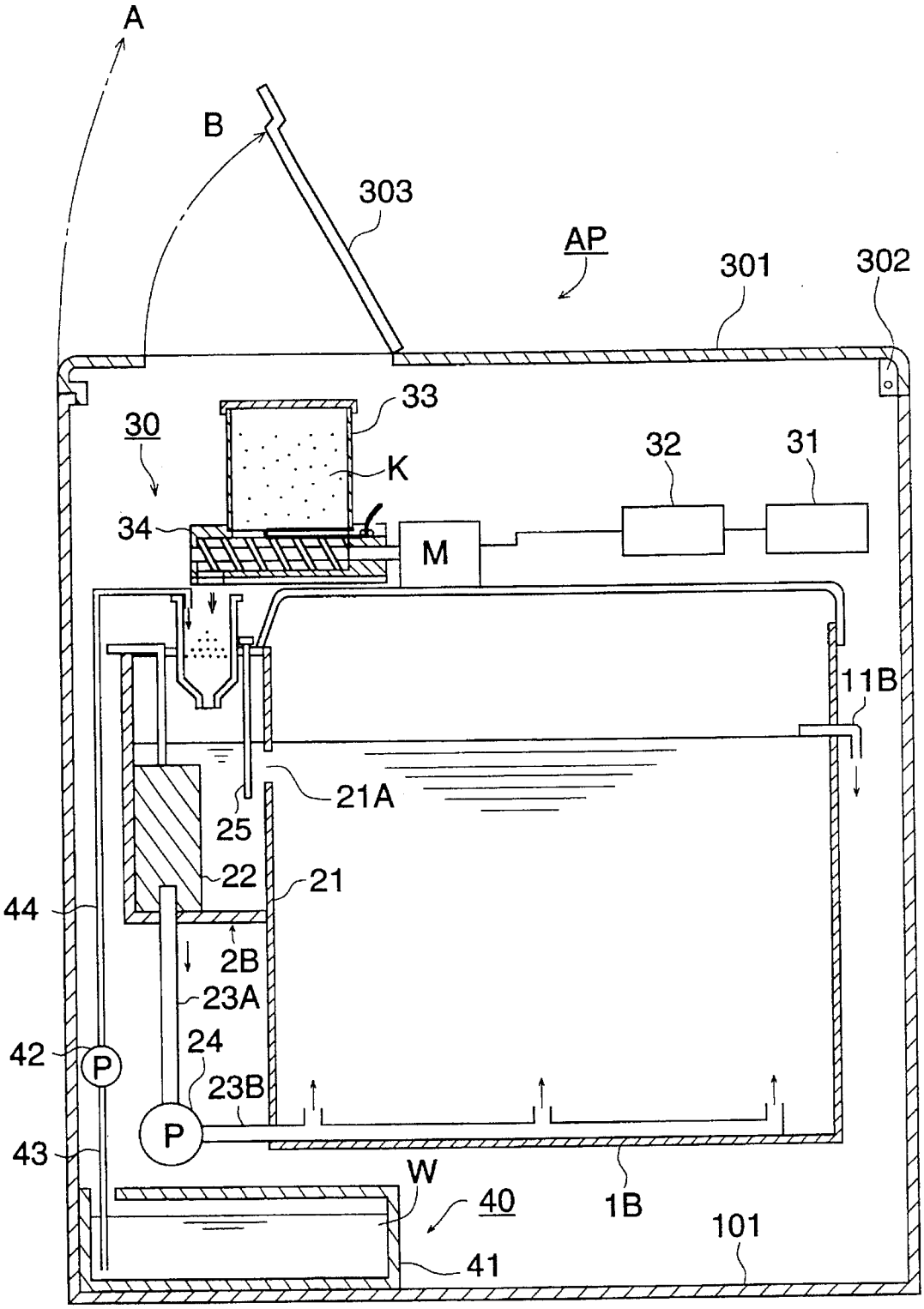
FIG. 3 is a sectional view of the automatic processing apparatus of the present invention.

FIG. 3 is a sectional view of the processing agent charging section and processing agent supply means of the bleaching and fixing tank 1B taken on line I—I in FIG. 2(A) showing the automatic processing apparatus AP. In this connection, for enhancing the understanding of the invention, the conveyance means for conveying the photosensitive material is omitted in the drawing. In this example, explanations will be made under the condition that granular type solid processing agent K is used.

The bleaching and fixing tank 1B for processing photosensitive material is provided with a dissolution tank 2B integrally attached to the outside of the partition wall 21 which composes the bleaching and fixing tank 1B. The bleaching and fixing tank 1B and the dissolution tank 2B are separated from each other by the partition wall 21 on which a communication hole 21A is formed. Therefore, the processing solution (bleaching and fixing solution) is communicated through the communication hole 21A.

A cylindrical filter 22 is disposed in the dissolution tank 2B in such a manner that the cylindrical filter 22 can be replaced. The cylindrical filter 22 removes impurities in the processing solution. A circulation pipe 23A connected with the suction side of a circulation pump 24 (circulation means) is inserted into the filter 22 passing through the lower wall of the dissolution tank 2B.

The circulation system includes the circulation pipes 23A, 23B forming a circulation passage of the processing solution, and also includes the circulation pump 24. One end of the circulation pipe 23B is communicated with the delivery side of the circulation pump 24, and the other end penetrates an outer wall of the bleaching and fixing tank 1B, so that the circulation pipe 23B is communicated with the bleaching and fixing tank 1B. Due to the foregoing construction, when the circulation pump 24 is operated, the processing solution is sucked from the dissolution tank 2B and discharged into the bleaching and fixing tank 1B, so that the discharged processing solution is mixed with the processing solution in the bleaching and fixing tank 1B, and then sent to the dissolution tank 2B. In this way, the processing solution is circulated. The circulating direction of the processing agent is not limited to the direction shown in FIG. 3, but the direction may be reverse to that shown in FIG. 3.

A waste solution pipe lib is provided for permitting the processing solution in the bleaching and fixing tank 1B to overflow, so the solution level can be maintained constant and an increase in the amount of components conveyed from other tanks into the bleaching and fixing tank 1B can be prevented. Further, an accumulation of the amount of components oozing out from the photosensitive material can be prevented.

A rod-shaped heater 25 penetrates an upper wall of the dissolution tank 2B, and is dipped in the processing solution in the dissolution tank 2B. The processing solution in the dissolution tank 2B and bleaching and fixing tank 1B is heated by this heater 25. In other words, the heater 25 is a temperature regulating means for regulating the temperature of the processing solution in the bleaching and fixing tank 1B, so that the temperature can be controlled to be maintained in an appropriate range, for example, in a range from 20° to 55° C.

A replenishing means for supplying a replenishing solution into the dissolution tank 2B includes a solid processing agent supply means 30 and a replenishing water supply means 40.

A throughput information detecting means 31 is disposed at an entrance of the automatic processing apparatus AP from which the photosensitive material is conveyed, and detects the throughput of the photosensitive material to be processed. This throughput information detecting means 31 comprises a plurality of detecting members that are disposed in a transverse direction. This throughput information detecting means 31 detects the width of photosensitive material, and the result of detection is used for counting the detection time. Since the conveyance speed of photosensitive material is previously set in a mechanical manner, the throughput of photosensitive material, that is, the area of processed photosensitive material can be calculated form the width and time information. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor shown in FIGS. 2(A)–2(B), a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. It is not necessary to provide the throughput information detecting means 31 for each processing tank 1A, 1B, 1C, 1D, 1E, and it is preferable that one throughput information detecting means 31 is provided for one automatic processing apparatus AP. The supply control means 32 includes: a processing agent supply control means for controlling the supply of solid processing solution in accordance with a signal sent from the throughput information detecting means 31; and a replenishment water supply control means for controlling the supply amount of replenishment water.

The solid processing agent supply device 30 used for the photosensitive material processing apparatus of the present invention includes: an accommodating container 33 for accommodating the granular type solid processing agent K; a supply device main body 34 which is a supply means; a motor M; and a drive means 37. The upper cover 301 of the automatic processing apparatus AP is rotatably connected with a main body 101 accommodating the bleaching and fixing tank 1B and the dissolution tank 2B, through a support shaft 302 attached to the back of the main body. The upper cover 301 is lifted upward as shown by a one-dotted chain line in FIG. 3, so that the front and upper portions of the apparatus can be widely opened. In this way, inspection of the solid processing agent replenishing device 30, and replacement of the filter 22 can be easily conducted.

A cover 303 is rotatably connected with a portion of the upper surface of the upper cover 301. When the cover 303 is opened as illustrated by a one-dotted chain line B in the drawing, the solid processing agent K is replenished into the accommodating container 33.

Figure 4:
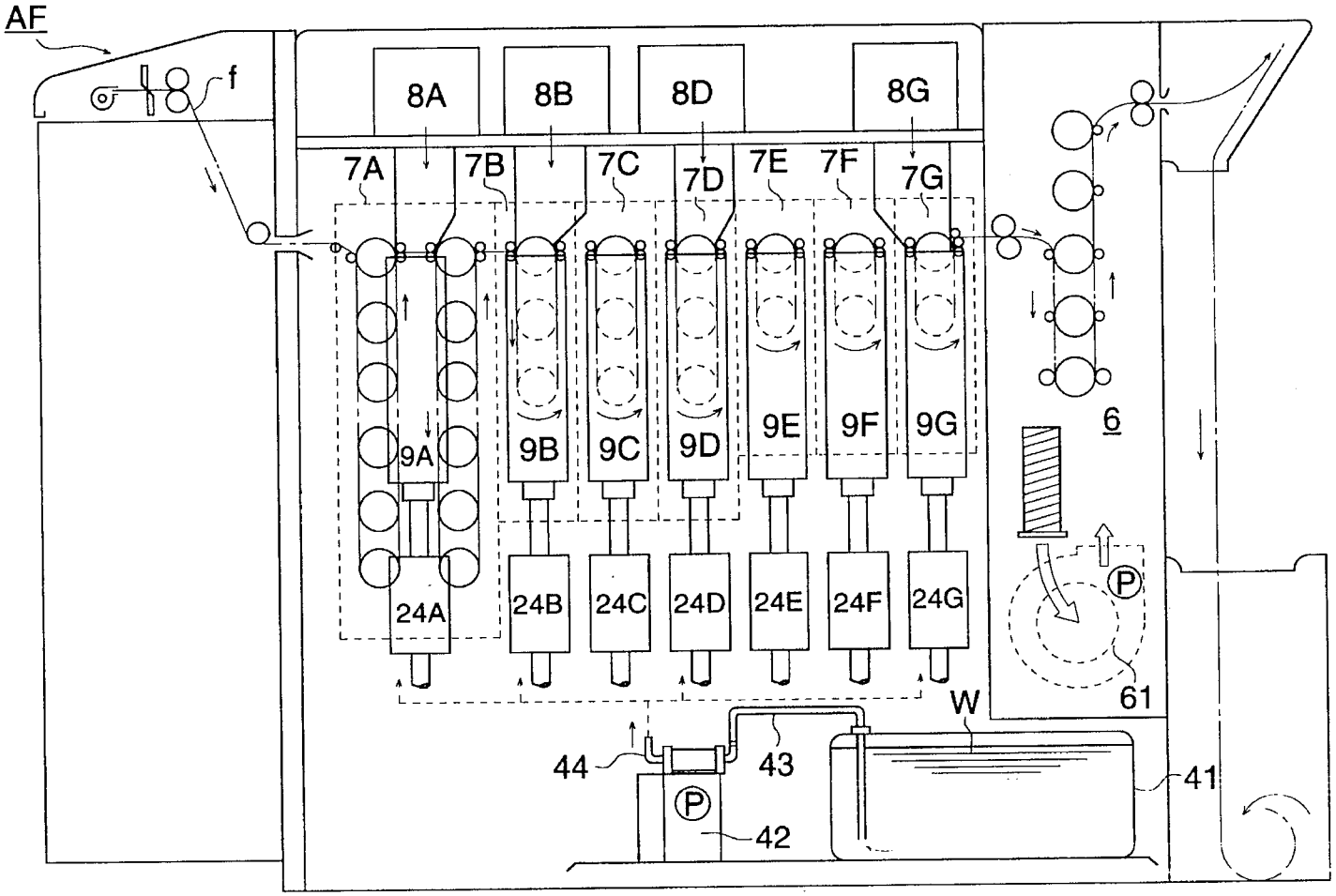
FIG. 4 is a front overall arrangement view of the automatic processing apparatus for developing negative photographic films.
Figure 5:
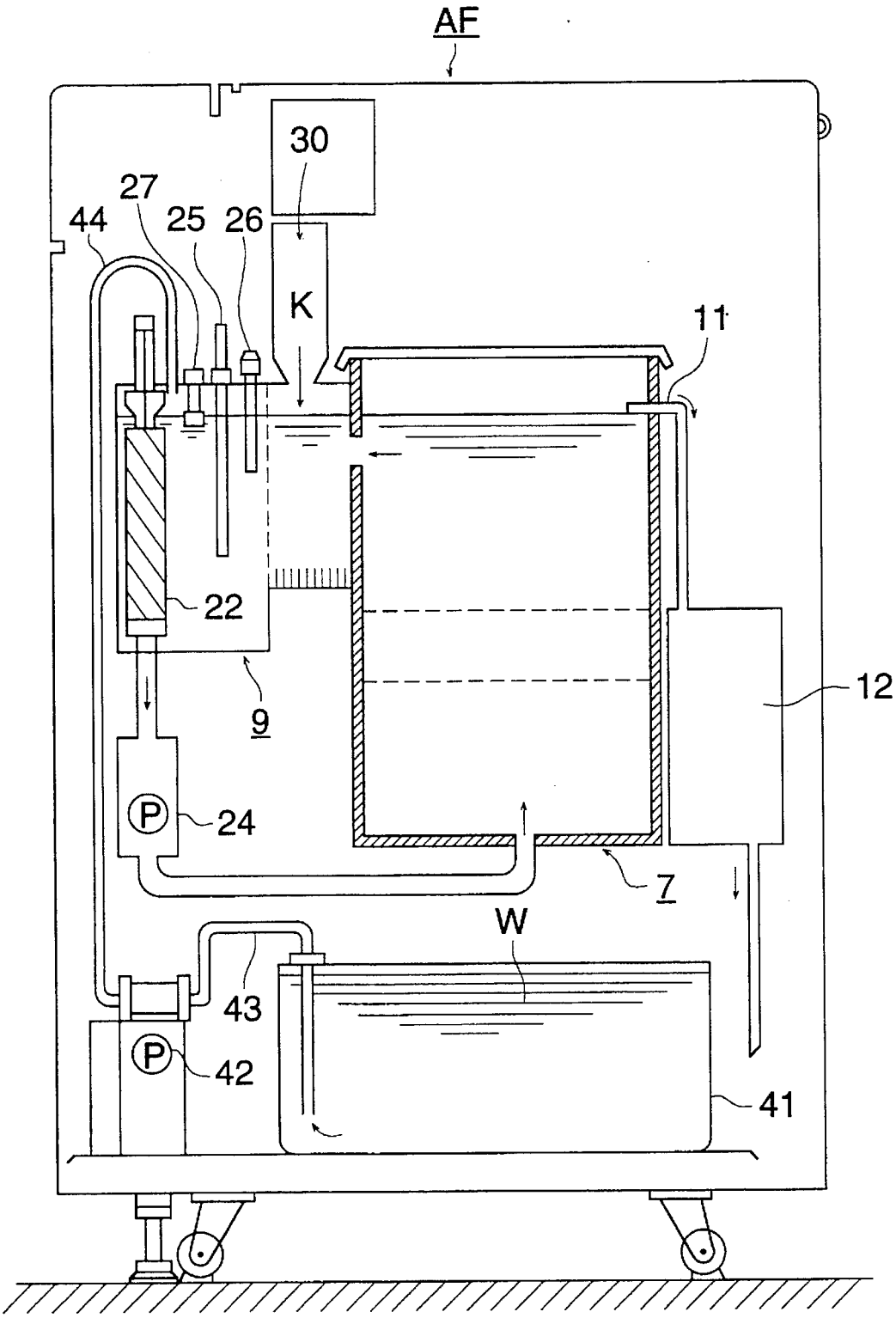
FIG. 5 is a sectional side view of the automatic processing apparatus for developing negative photographic films.

FIG. 4 is an overall arrangement view showing the front of the color negative film automatic processing apparatus AF to which the present invention is applied. FIG. 5 is a sectional side view of the automatic processing apparatus AF. The automatic processing apparatus AF is substantially composed of 4 processing solution tanks including a color developing tank 7A, bleaching tank 7B, fixing tanks 7C, 7D and stabilizing tanks 7E, 7F, 7G.

The processing solution tanks 7A, 7B, 7D, 7G are respectively communicated with the dissolution tanks 9A, 9B, 9D, 9G, and the processing solutions are circulated and stirred by the circulation pumps 24A, 24B, 24D, 24G. The aforementioned solid processing agent supply devices 8A, 8B, 8D, 8G are respectively attached onto the dissolution tanks 9A, 9B, 9D, 9D. An appropriate amount of solid processing agent is supplied by each solid processing agent supply device. In this connection, reference numerals 9C, 9E, 9F are circulation tanks.

Replenishment water W provided in a common replenishment water tank 41 is supplied to the dissolutions 9A, 9B, 9D, 9G through the bellows pump 42, suction pipe 43 and water supply pipe 44.

In FIG. 4, one-dotted chain lines show the conveyance passages of the color photographic film f. The photographic film f is pulled out from a cartridge charged into the charging means. Then the photographic film f is processed in the color developing tank 7A, bleaching tank 7B, fixing tanks 7C, 7D and stabilizing tanks 7E, 7F, 7G. After the processing has been completed, the photographic film f is dried by a fan heater 61 provided in the drying section 6. Then the dried film is discharged outside of the apparatus.

In FIG. 5, numeral 12 is a waste solution tank for storing a solution that has overflowed, numeral 26 is a thermostat, and numeral 27 is a level sensor. In this connection, like reference characters are used to indicate like parts in FIGS. 3 and 5.

Figure 6:
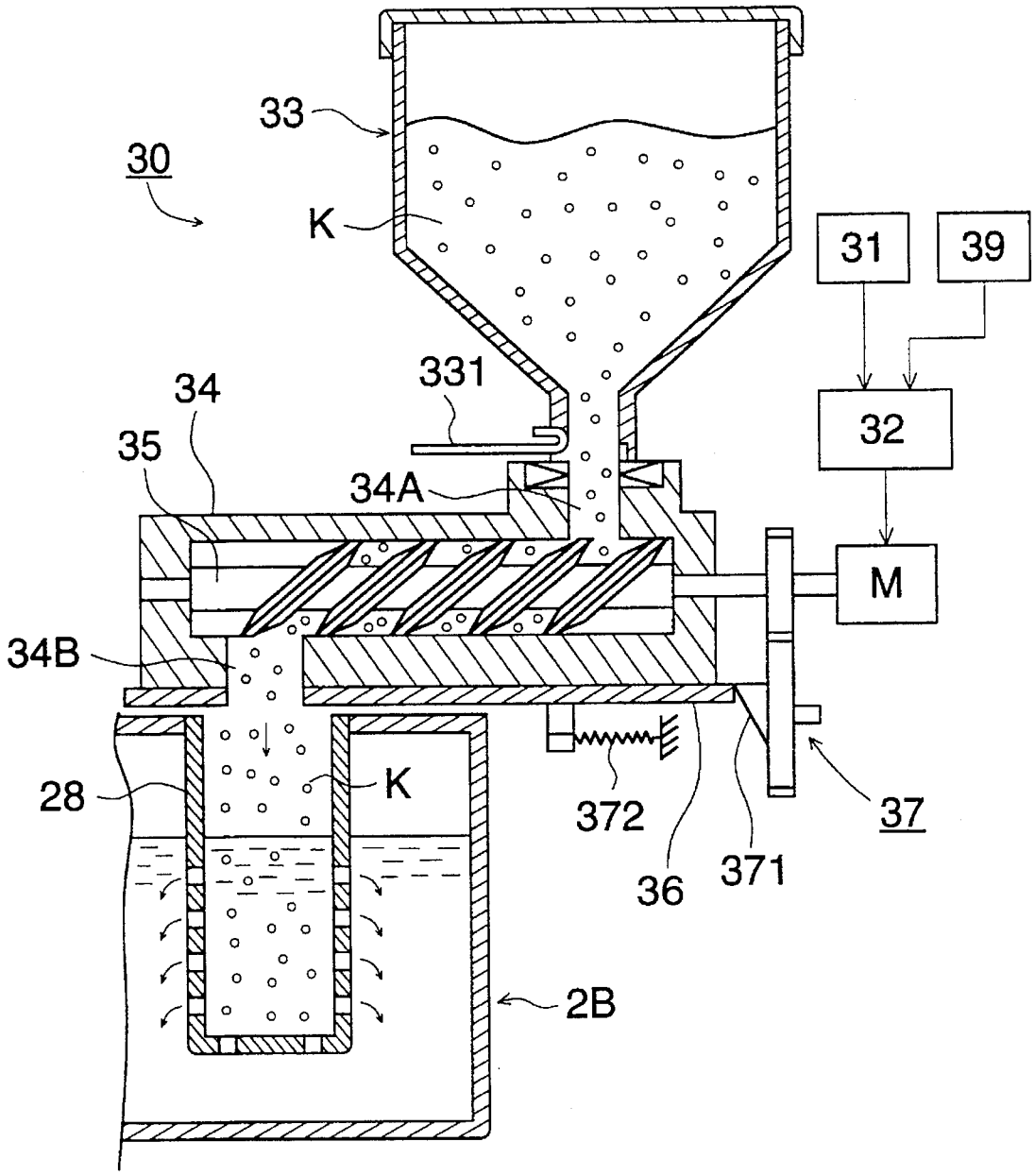
FIG. 6 is a sectional view of the solid processing agent supply means.

FIG. 6 is a sectional view showing the detail of the solid processing agent supply means 30.

In this example, a granular type, powder type or pellet type solid processing agent is used.

The solid processing agent supply means 30 includes: an accommodating container (cartridge) 33 for accommodating the granular type (powder type or pellet type) solid processing agent K, the accommodating container 33 being detachably provided; a supply device 34 for receiving and supplying the solid processing agent K to the dissolution tank 2B by the action of the conveyance screw 35 which conveys the solid processing agent K from the receiving opening 34A to the discharge opening 34B; a shutter 36 for opening and closing the discharge opening 34B; and a drive means 37. The solid processing agent K is accommodated in the accommodating container 33. When the solid processing agent K is not used yet, the outlet of the accommodating container 33 is airtightly closed with a seal 331. After the accommodating container 33 has been attached to the supply device 34, the seal 331 is peeled off. Then the solid processing agent K is conveyed by the rotation of the conveyance screw driven by the drive means 37, so that the solid processing agent K is discharged from the discharge opening 34B and dispensed into the dissolution tank 2B. The shutter 36 is movably provided at a position close to the discharge opening 34B. This shutter 36 is opened by the action of a cam 371 of the drive means 37 driven by the motor M. When this shutter 36 is opened, it resists the spring force of the spring 372. In this way, the solid processing agent K is charged into the dissolution tank. When the number of revolutions of the motor M is controlled, an amount of the solid processing agent K supplied in one operation is determined, so that a predetermined amount of the solid processing agent K can be supplied. In the accommodating container 33, one set of the solid processing agent K is accommodated, that is, 100 $cm^3$ to 2000 $cm^3$ of the solid processing agent K is accommodated, and it is more preferable that 200 $cm^3$ to 1500 $cm^3$ of the solid processing agent K is accommodated in the accommodating container 33. A mesh-shaped enclosure 28 is disposed at a position below the discharge opening 34B of the supply device 34 and above the dissolution tank 2B. The solid processing agent K dispensed by the solid processing agent supply means 30 is received by the mesh-shaped enclosure 28. The enclosure 28 is a filter member for temporarily storing the solid processing agent K. However, a component of the solid processing agent K that has not been solved yet or a component that is not dissolved in the processing solution may move into the dissolution tank 2B. A numeral 39 will be explained later in FIG. 10.

Figure 7:
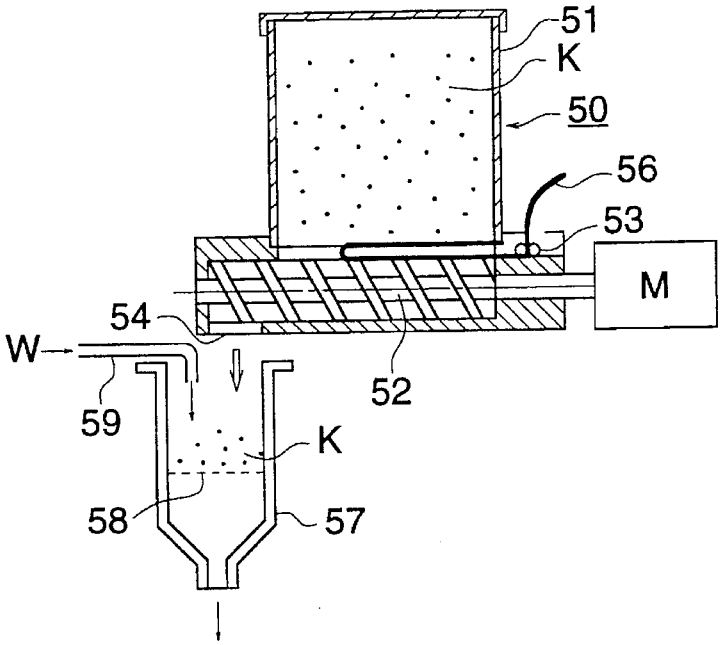
FIG. 7 is a sectional view of another example of the solid processing agent supply means.

FIG. 7 is a sectional view of the screw type solid processing agent supply means 50 of another example of the present invention.

The supply means 50 includes a package 51 in which the solid processing agent K is charged. When the seal 56 is peeled off the action of a roller 53, the package 51 automatically opened. When the number of revolutions of the conveyance screw 52 is controlled, a predetermined amount of the solid processing agent K is supplied to the discharge section 54. Numeral 57 is a receiving means for receiving replenishment water W, numeral 58 is a filter member, and numeral 59 is a replenish water supply pipe for replenishing replenishment water W.

As described above, this supply means 50 has a function in which the package 51 is automatically opened. Therefore, even when the package 51 is opened and closed, fine powder is not scattered, so that the working environment can be maintained clean.

Figure 8:
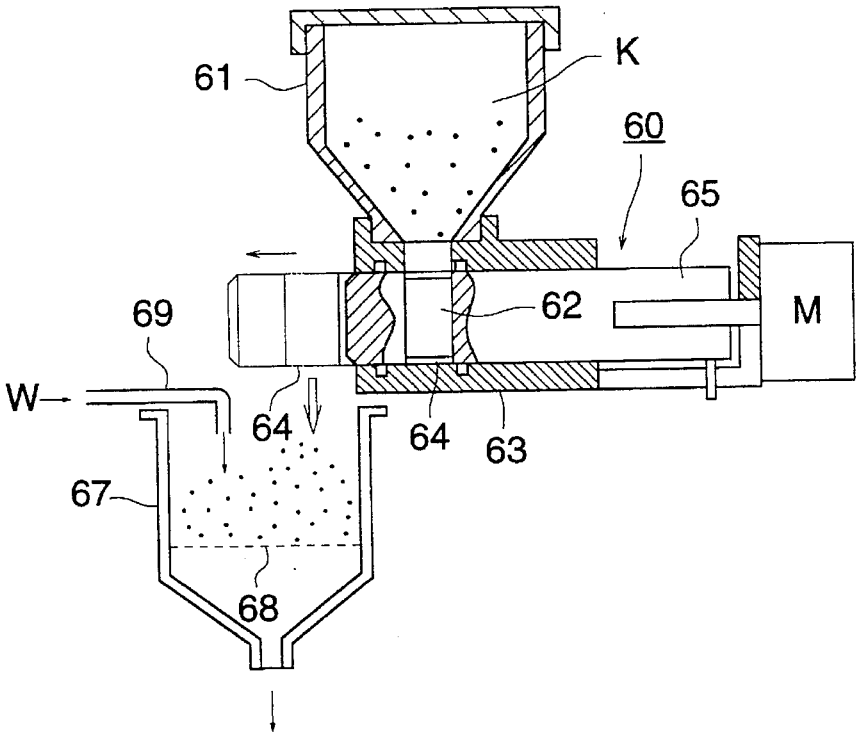
FIG. 8 is a sectional view of still another example of the solid processing agent supply means.

FIG. 8 is a sectional view of the sliding type solid processing agent supply means 60 of another example of the present invention. An accommodating chamber 61 in which the granular type solid processing agent K is accommodated is detachably attached to the supply device 63. A piston 65 is driven being controlled in accordance with the throughput of photosensitive material. When the piston 65 is horizontally moved to the right, a predetermined amount of the solid processing agent K is put into a measuring hole 62. When the piston 65 is oppositely moved to the left, the predetermined amount of the solid processing agent K is supplied to the receiving means 67 through a discharging section 64. In a lower portion of the discharging section 64, there are provided a receiving means 67, a filter member 68 and a replenishment water supply pipe 69 for replenishing water W.

Figure 9:
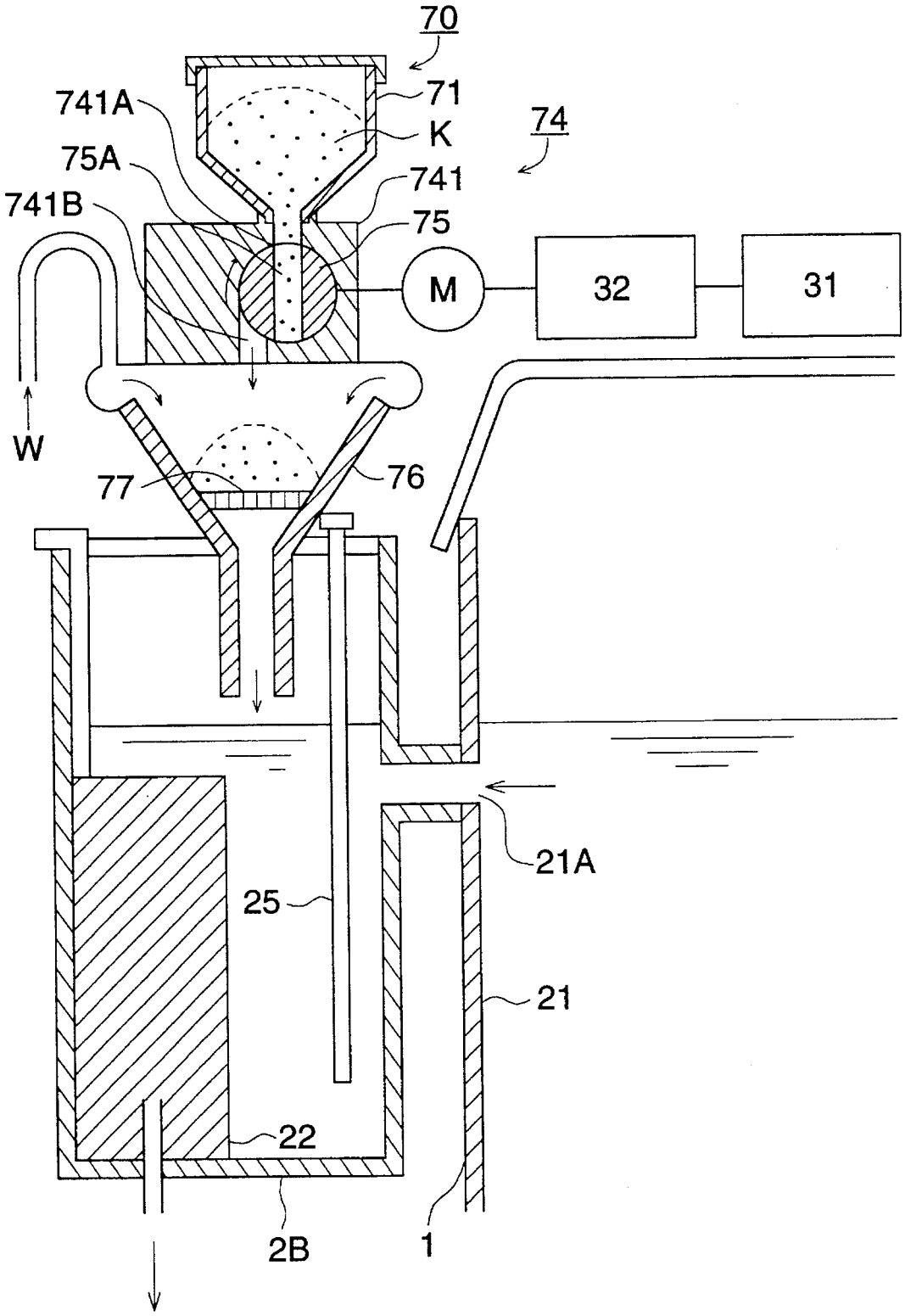
FIG. 9 is a sectional view of still another example of the solid processing agent supply means.

FIG. 9 is a sectional view of the rotor type solid processing agent supply means 70 of another example of the present invention.

An accommodating container 71 in which the granular type (powder type or pellet type) solid processing agent K is accommodated is detachably attached to an upper portion of the supply device 74. A fixed main body 741 of the supply device 74 includes a receiving opening 741A, a discharge opening 741B, and a cylindrical cavity portion in which the rotational conveyance member (rotor) 75 is slidably rotated. The rotational conveyance member (rotor) 75 is provided with a measuring hole 75A by which a predetermined amount of solid processing agent K is received and conveyed. When the conveyance member 75 is rotated, the solid processing agent K accommodated in the accommodating container 71 is introduced from the receiving opening 741A and a predetermined amount of the solid processing agent is measured by the measuring hole 75A. After that, the measured solid processing agent is charged into the dissolution tank 2B from the discharge opening 741B. Numeral 76 is a receiving means arranged in an upper portion of the dissolution tank 2B. The receiving means 76 receives the solid processing agent K supplied from the upward portion and also receives replenishment water W. The solid processing agent K and replenishment water W pass through the filter member 77, and are dispensed into the processing solution in the dissolution tank 2B.

Figure 10:
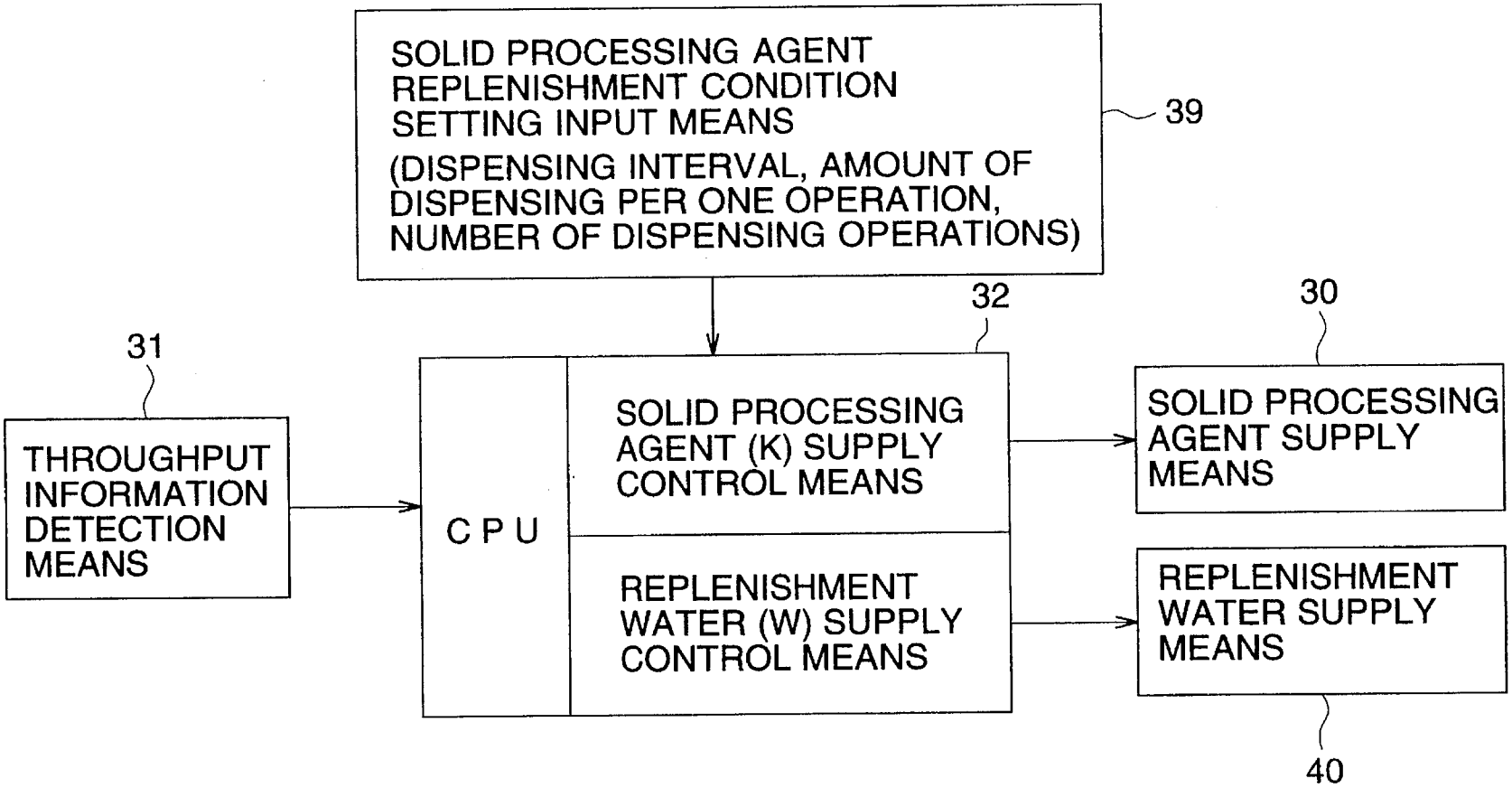
FIG. 10 is a block diagram of supply control for controlling the solid processing agent and replenishment water.
Figure 11:
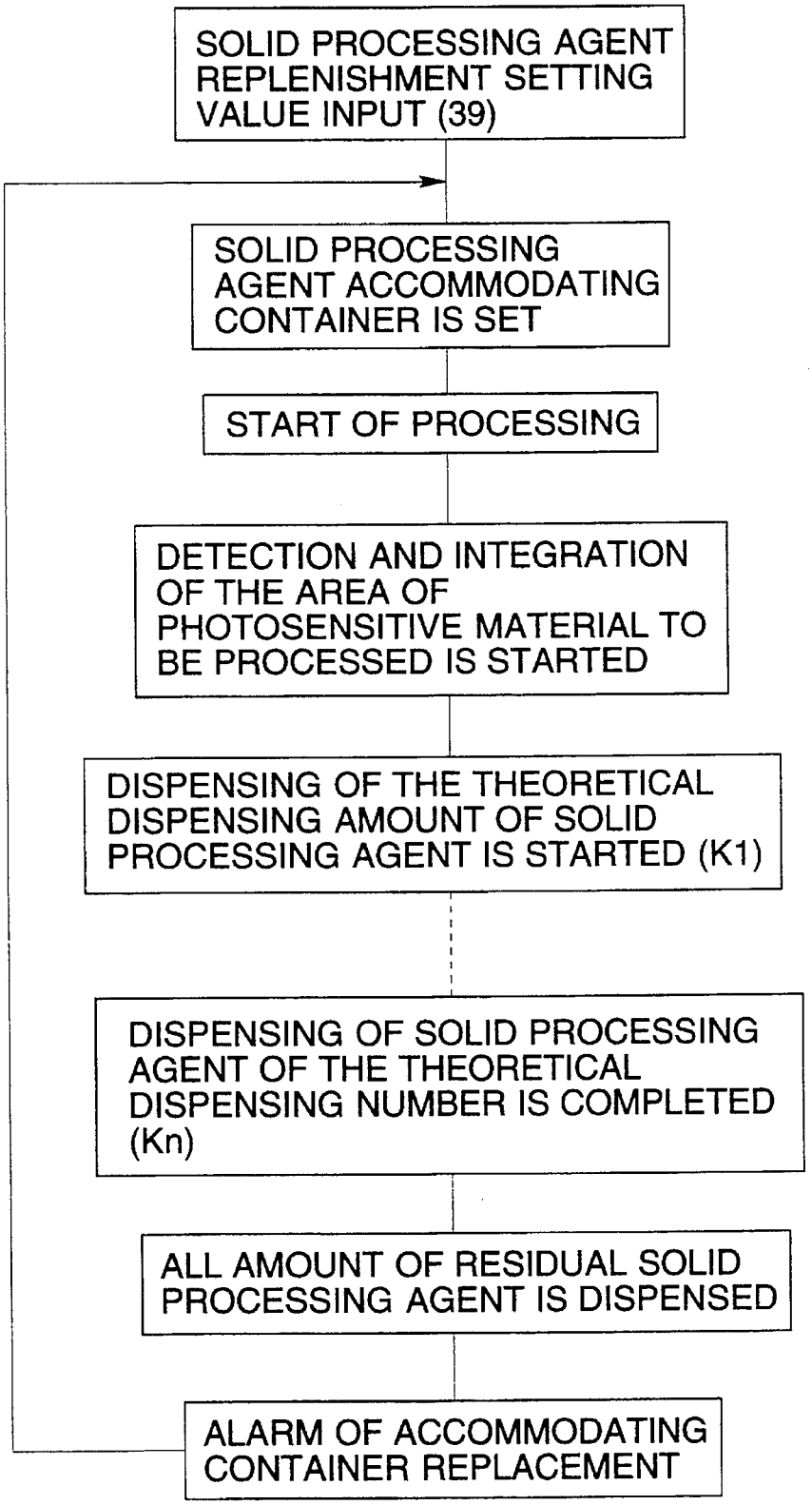
FIG. 11 is a flow chart showing the solid processing agent replenishment process.

FIG. 10 is a block diagram for controlling the supply of the solid processing agent and replenishment water. FIG. 11 is a flow chart showing the solid processing agent replenishment process. Throughput information of the photosensitive material (photographic paper S) conveyed into the automatic processing apparatus AP is detected by the detection means 31 and sent to the supply control means 32. Then predetermined amounts of solid processing agent K and replenishment water W are dispensed into the dissolution tank 2B by the supply means 30, 40. These replenishing operations of the solid processing agent K and replenishment water W are intermittently carried out by a plurality of times ($k_1$ to $k_n$) each time the detection means 31 generates a signal.

Figure 12:
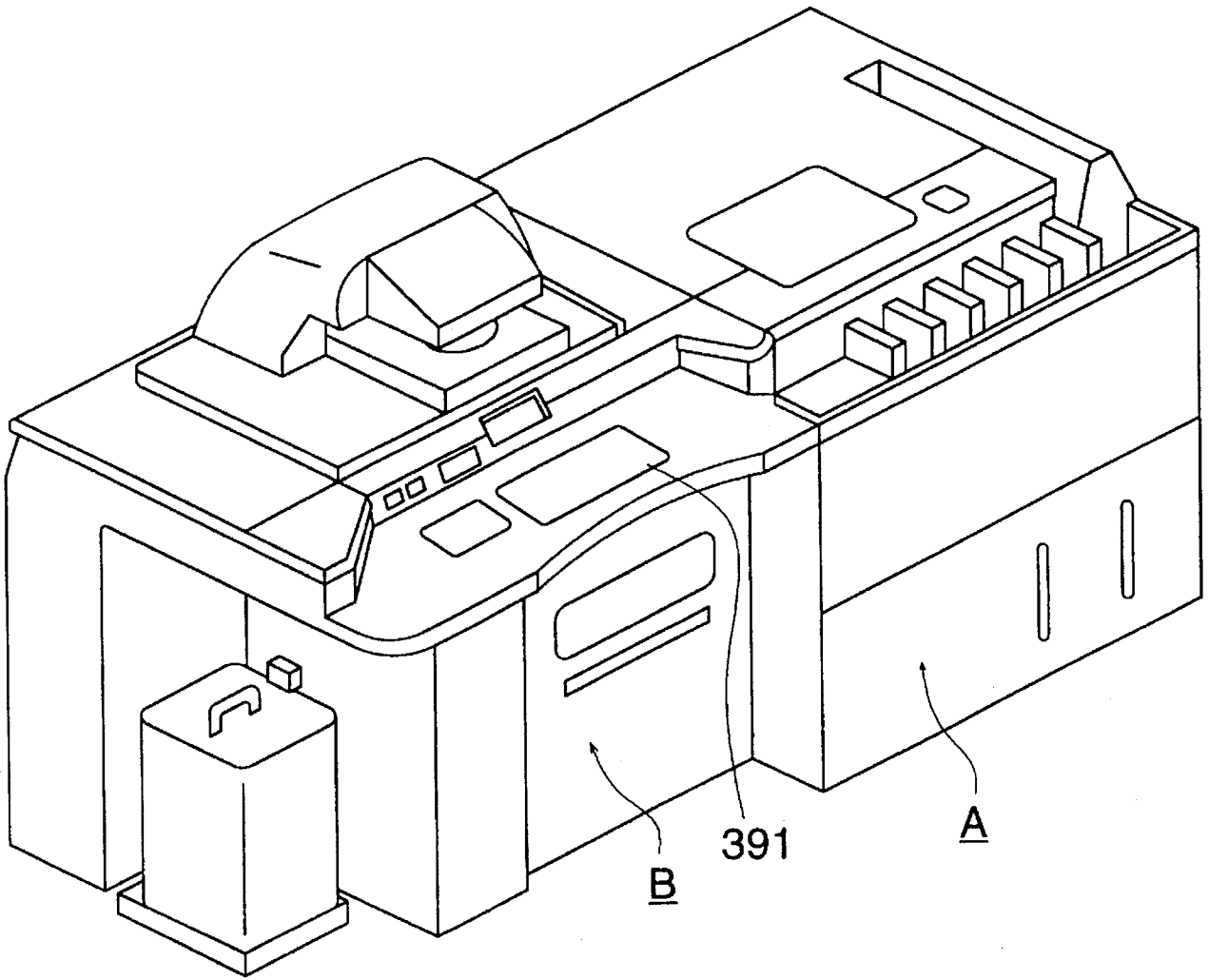
FIG. 12 is a perspective view for showing an outer appearance of the color print processing apparatus.
Figure 13:
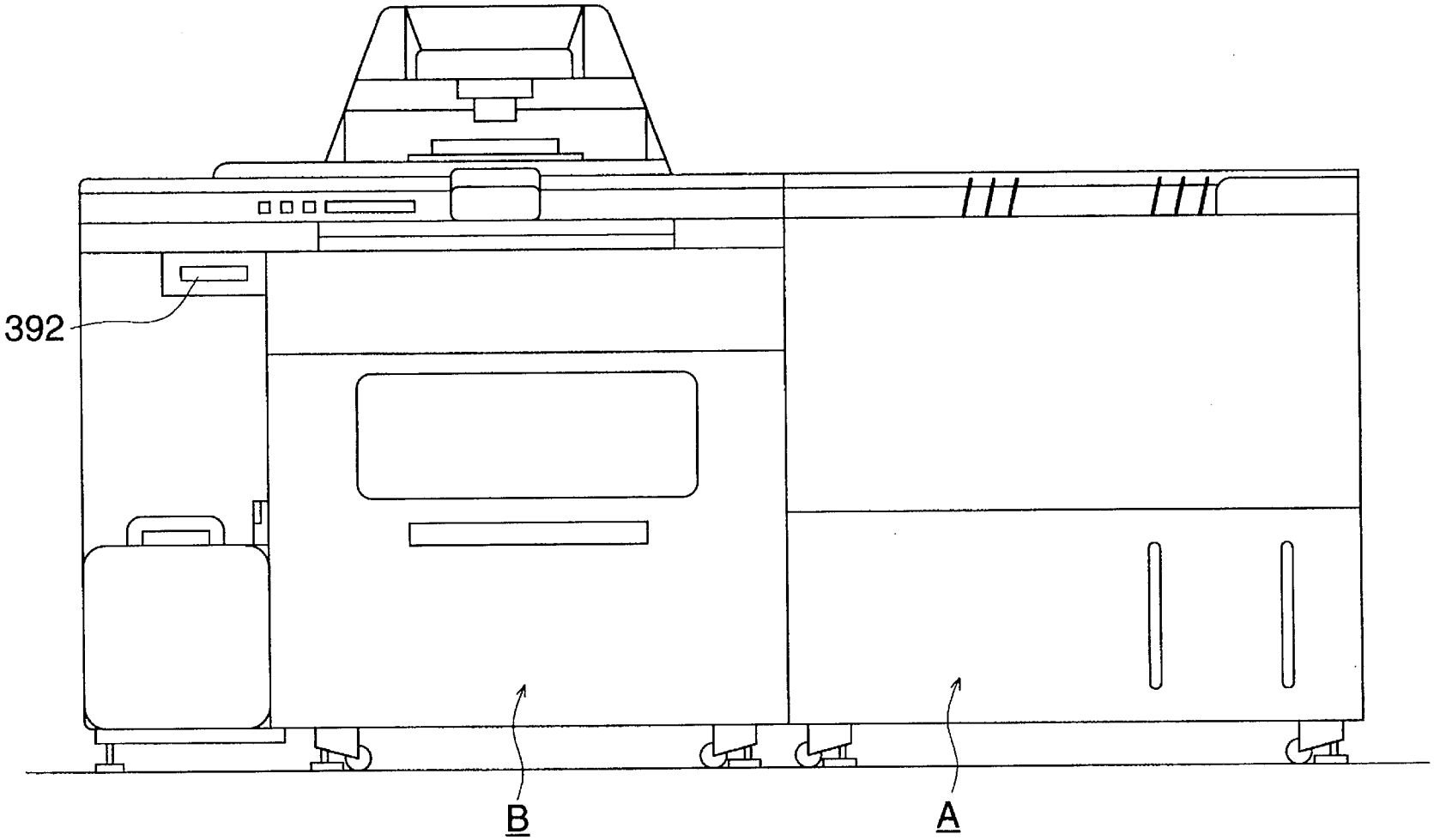
FIG. 13 is a front view of the color print processing apparatus.

The supply control is carried out by the supply control means 32. Predetermined setting values that have been previously set by the solid processing agent replenishment condition setting input means 39, which are a dispensing interval of the solid processing agent K, a dispensing amount of one dispensing operation and a theoretical dispensing frequency, are set for each replenishment agent and inputted into the supply control means 32. FIG. 12 is a perspective view showing the outer appearance of a color print processing apparatus. FIG. 13 is a front view of the color print processing apparatus. Values of the conditions are inputted into the solid processing agent replenishment condition setting input means 39 through the manual operation on the key board 391. In order to simplify the operation, it is preferable that the values of the conditions are inputted through a floppy disk 392.

When the number of dispensing operations of the solid processing agent K has reached the aforementioned theoretical dispensing frequency ($k_n$), it is controlled that all of the solid processing agent K remaining in the accommodating container 33 (51, 61, 71) is dispensed at the final charging operation. Specifically, in the conveyance screw system shown in FIGS. 6 and 7, the number of revolutions of the conveyance screw 35 (52) is increased at the final replenishment operation so as to additionally drive the drive circuit and all amount of the solid processing agent K in the accommodating container 33 (51) is discharged. Due to the foregoing, even when an error is caused in each replenishment operation ($K_1$ to $k_n$), errors are canceled when the supply of one set of the solid processing agent K in the accommodating container 33 (51) is completed, so that one set of the solid processing agent K can be accurately replenished.

In the predetermined amount measuring system illustrated in FIGS. 8 and 9, after the completion of the final replenishment operation, the piston 65 or the rotor 75 is additionally rotated, so that the residual solid processing agent in the accommodating containers 61, 71 is discharged and all amount of one set of the solid processing agent is accurately replenished into the dissolution tank 2B at the time of final replenishing operation.

After all amount of the solid processing agent has been discharged from the accommodating container 33 (51, 61, 71) in this way, an alarm to replace the accommodating container is generated, and the container is replaced in accordance with the alarm.

In the above example, the present invention is applied to the automatic color processing apparatus AP, which is substantially composed of 3 processing tanks including the color developing tank 1A, bleaching and fixing tank 1B and stabilizing tanks 1C, 1D, 1E. However, it should be noted that the present invention is not limited to the specific example. For example, the present invention can be applied to an automatic processing apparatus substantially composed of 4 tanks including the color developing tank 7A, bleaching tank 7B, fixing tanks 7C, 7D and stabilizing tanks 7E, 7F, 7G. Further, the present invention can be applied to an automatic processing apparatus AF substantially having not less than 4 processing tanks for processing color negative photographic films. That is, the control method of the present invention in which all amount of one set of the solid processing agent in the accommodating container is dispensed can be applied to an automatic processing apparatus AF substantially having not less than 4 processing tanks for processing color negative photographic films.

An example in which the tablet J is used as the solid processing agent will be explained below.

Figure 14:
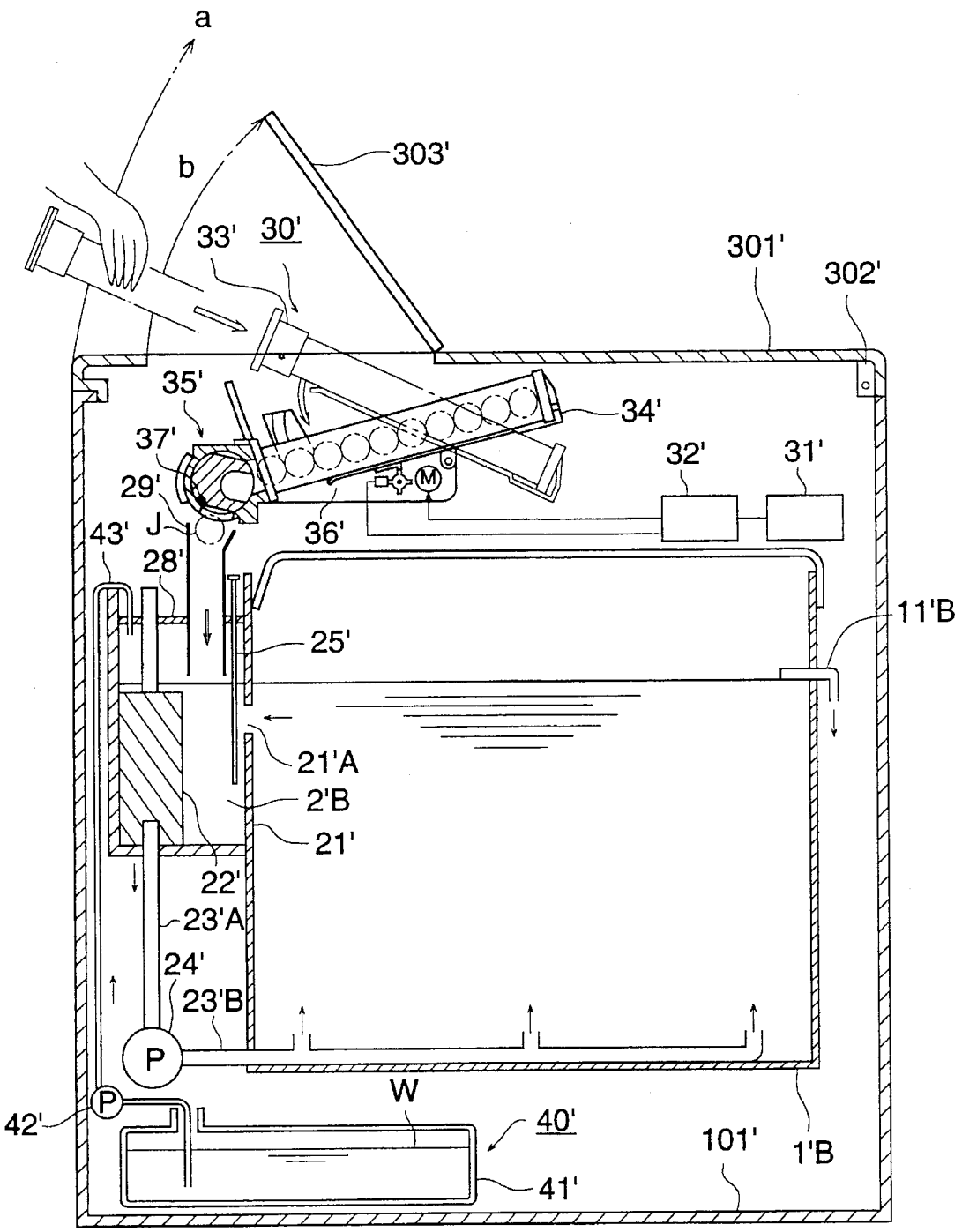
FIG. 14 is a sectional view of the automatic processing apparatus in which the granule supply section shown in FIG. 3 is replaced with a tablet cartridge.

In FIG. 14, the granule supply section illustrated in FIG. 3 is replaced with a tablet cartridge.

The solid processing agent supply means 30' of the present invention includes: an accommodating container cartridge 33' for accommodating the tablet type solid processing agent J; an accommodating container charging means 34'; a solid processing agent (tablet) replenishing means 35'; a drive means 36'; and a solid processing agent dispensing detection sensor 37'.

Figure 15:
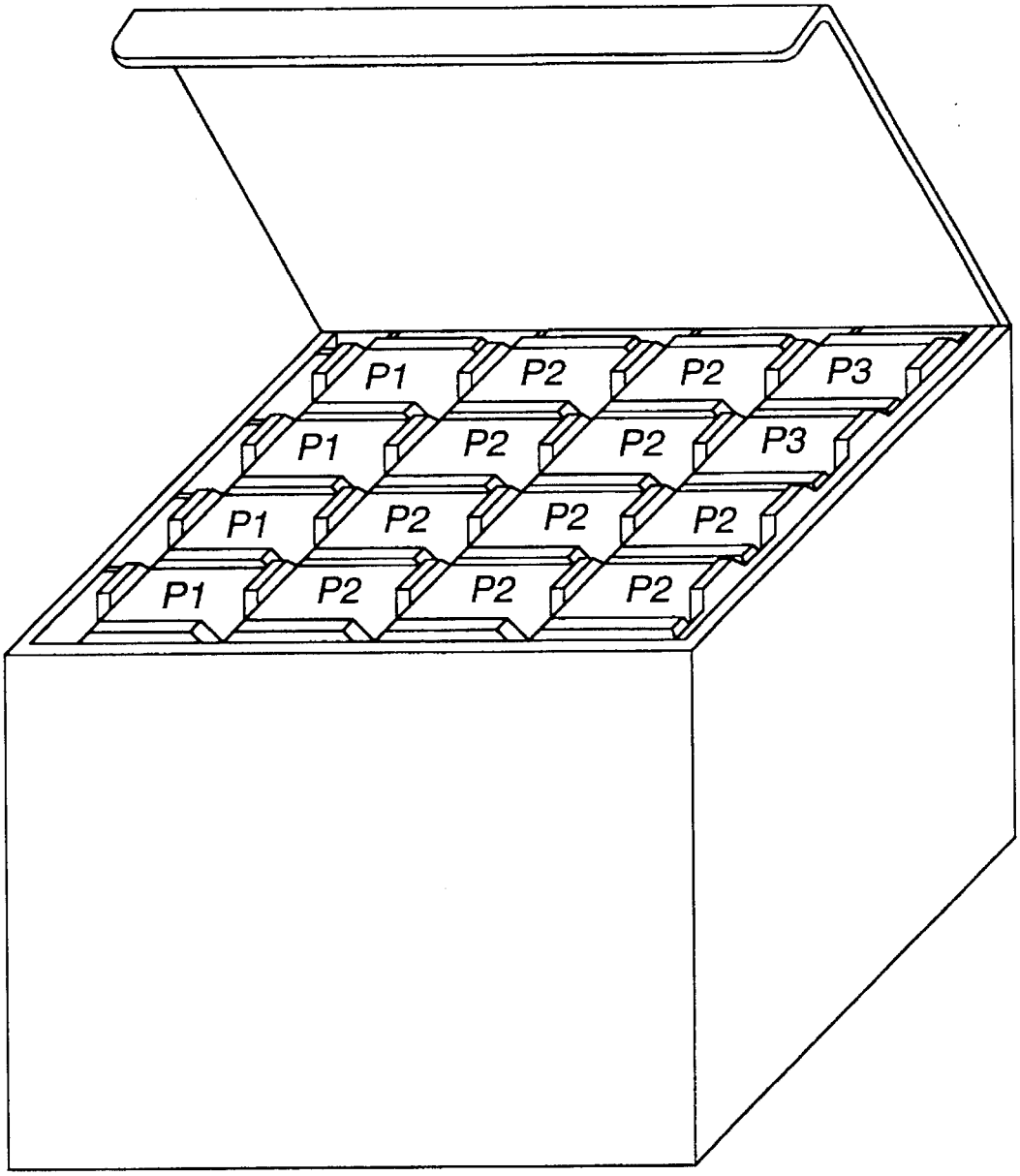
FIG. 15 is a perspective view showing the circumstances of kits of tablets accommodated in a card-board box.

The aforementioned solid processing agent J is accommodated in the cartridge. In this case, several cartridges are formed into a set kit, and the set kit is accommodated in a cardboard box as illustrated in FIG. 15.

An example is shown on Table 2.

TABLE 2

| | Number of tablets in a cartridge | Number of cartridges in a set kit | Total number of tablets in a set kit |
|---|---|---|---|
| Color development replenisher tablets | 40 | 4 | 160 |
| Bleach-fix replenisher tablets | 40 | 10 | 400 |
| Super stabilizer replenisher tablets | 10 | 2 | 20 |

For example, one set kit described on the above table contains an amount of tablets necessary for processing sheets of photographic color paper, the area of which 214 $m^2$.

Figure 16:
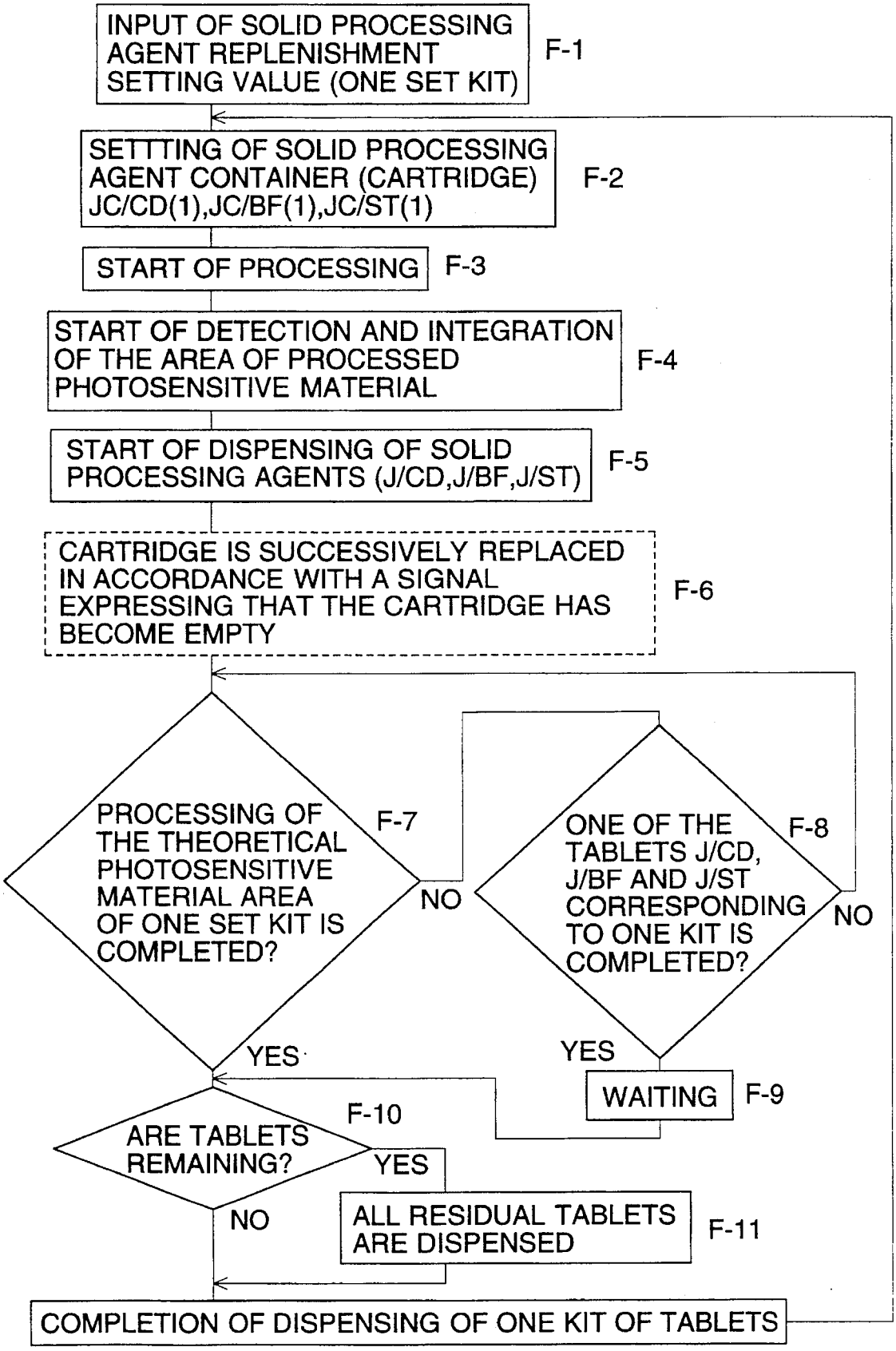
FIG. 16 is a flow chart showing the detection and correction of charged tablets in each kit.

FIG. 16 shows a flow in which the replenishment of tablets is detected and corrected for each kit so as to check whether or not a correct amount of tablets are replenished.

In this case, the cartridge for color development replenishing tablets is expressed by JC/CD, the cartridge for bleaching and fixing replenishing tablets is expressed by JC/BF, and the cartridge for super stabilizer replenishing tablets is expressed by JC/ST. In this case, tablets are respectively expressed by J/CD, J/BF and J/ST.

As illustrated in FIG. 16, the area (214 $m^2$) of the total photosensitive material and the number of tablets (J/CD: 160, J/BF: 400, J/ST: 20) are inputted (F-1), wherein these values are replenishment setting values of one set kit. Next, JC/CD, JC/BF and JC/ST, which are solid processing agent containers (cartridges), are attached to each accommodating container charging means 34' (F-2). Then the processing of color photographic paper is started (F-3). The throughput of this color photographic paper is detected and accumulated by the throughput information detecting means 31' (F-4). At the timed relation of J/CD, J/BF and J/ST, signals are sent from the solid processing agent supply control means 32', so that the solid processing agent supply means 33' is driven and the tablets J are supplied (F-5).

In accordance with information sent from the solid processing agent charging detection sensor 37', a cartridge that has become empty is successively replaced (F-6). When the dispensing operation is smoothly carried out, it must be completed at the theoretical timing. However, when the tablet is stopped up, it does not drop smoothly, and when the test mode is mistakenly operated, an excessive amount of tablets are dropped. In the above cases, the dispensing operation is not completed in the theoretical time period.

For example, in the case where the solid processing agent dispensing detection sensor 37' detects that all tablets corresponding to one set kit have been dispensed (F-7) before the completion of processing of the theoretical photosensitive material area (214 $m^2$) of one set kit (F-8), a signal of the completion is not emitted, and the solid processing agent supply means 30' waits until the completion of processing of the theoretical photosensitive material area (F-9). In the case where the tablets remain in the cartridge even after the completion of processing of the theoretical photosensitive material area corresponding to one set kit (F-10), the residual tablets are forcibly supplied by driving the solid processing agent supply means 34' (F-11).

As described above, according to the stoppage of supply and forcible supply of the present invention, it is possible to adjust an amount of supply of solid processing agent to the theoretical value. Therefore, the solid processing agent can be accurately replenished.

As explained above, the automatic processing apparatus for developing silver halide photosensitive material and supply method of supplying solid processing agent used for silver halide photosensitive material and supply device of the present invention can provide the following effects.

(1) Even when the deviations of the shape, volume, weight and composition of the solid processing agent are caused by the influence of environmental humidity or vibration given in the process of transportation, the error caused in the replenishment amount is not accumulated.

(2) It is not necessary to provide a complicated and precise replenishing device, and accurate replenishing operation can be carried out by an inexpensive replenishing device.

(3) It is not necessary to provide a residual amount detection means and control means for detecting and controlling the solid processing agent in the accommodating container.

(4) There is no precipitation in the processing tank, so that the filter is not stopped up. Accordingly, the replenishment solution is stably circulated in the filter section, and processing can be carried out uniformly.

What is claimed is:

1. A solid processing agent supply device for use in an automatic processing apparatus including a processing solution tank for processing a silver halide photosensitive material, the device comprising:

(a) a container for accommodating one set of a solid processing agents in the form of granules, powder, pellets or tablets which can process a predetermined amount of the material;

(b) detecting means for detecting an amount of the material to be processed;

(c) condition setting input means for setting a condition to divide said one set of the solid processing agent accommodated in the container into said plurality of portions;

(d) supply means for dividing said one set of the solid processing agent accommodated in the container into a plurality of portions and for supplying the divided solid processing agent into the processing solution tank, based on said set condition; and (e) solid processing agent supply control means for controlling said supply means so that a supply of said one set of solid processing agent can be forcibly completed by said supply means at a theoretical completion time of the supply of said one set of solid processing agent.

2. An automatic processing apparatus including a processing solution tank for processing a silver halide photosensitive material, the apparatus comprising (a) a container for accommodating a set of solid processing agents;

(b) a detector for detecting an amount of the photosensitive material processed;

(c) a supplier for supplying an amount of the solid processing agents in accordance with the amount of photosensitive material detected by the detector; and (d) a control device for controlling the supplier, wherein, when the amount of photosensitive material reaches a predetermined value, the control device directs a supplier to supply all of the remaining solid processing agents to the processing solution tank.

3. The automatic processing apparatus of claim 2, wherein the predetermined value is a theoretical amount of the photosensitive material which can be processed by a preset amount of solid processing agents.

4. The automatic processing apparatus of claim 2 further comprising a device for presetting a replenishment condition to the supplier, the replenishment condition comprising:

(a) a charging interval;

(b) a charging amount of one charging operation; and (c) a theoretical charging frequency based upon a number of charging operations of the set of solid processing agents, wherein, when the number of charging operations reaches the theoretical charging frequency, all of the solid processing agents remaining in the container are supplied to the processing tank in a final charging operation.

5. An automatic processing apparatus including a processing solution tank for processing a silver halide photosensitive material, the apparatus comprising:

(a) a container for accommodating a set of solid processing agents therein for processing a predetermined amount of photosensitive material;

(b) a detector for detecting the amount of the photosensitive material processed;

(c) a supplier for supplying the processing solution tank with an amount of solid processing agents in accordance with the amount of photosensitive material detected by the detector; and (d) a control device for controlling the supplier, wherein, when no solid processing agents remain in the container and the predetermined amount of photosensitive material has not been reached, the controller prevents another set of processing agents from being supplied until the amount of photosensitive material reaches the predetermined value.

* * * * *